United States Patent [19]

Walters

[11] Patent Number: 4,936,237

[45] Date of Patent: Jun. 26, 1990

[54] DUAL BOAT HULL

[76] Inventor: Victor Walters, P.O. Box 250, Sechelt, B.C., Canada, V0N 3A0

[21] Appl. No.: 276,701

[22] Filed: Nov. 28, 1988

[51] Int. Cl.[5] ..... B63B 1/12

[52] U.S. Cl. ..... 114/61; 114/62

[58] Field of Search ..... 114/56, 61, 62, 67 A

[56] References Cited

U.S. PATENT DOCUMENTS

| | | | |
|---|---|---|---|
| 919,694 | 4/1909 | Chase | 114/61 X |
| 1,815,303 | 7/1931 | Kloen | 114/62 X |
| 2,464,957 | 3/1949 | Wood | 114/61 |
| 3,447,502 | 6/1969 | Leopold | 114/61 |
| 3,791,329 | 2/1974 | Beuning | 114/61 |

*Primary Examiner*—Sherman D. Basinger

*Attorney, Agent, or Firm*—David J. French

[57] ABSTRACT

A boat with dual hulls is constructed of outwardly concave cylindrical hull plates that are substantially free of compound curvature. The respective hull portions may be closed at their ends by outwardly concave cylindrical bow and stern plates.

7 Claims, 5 Drawing Sheets

DUAL BOAT HULL

FIELD OF THE INVENTION

This invention relates to hull configurations for ships, boats and sea-going vessels. More particularly, it relates to a dual or catamaran-style form of hull.

Background to the Invention

Twin or catamaran-style hulls are well-known as a general concept. Such hulls are however, generally made with surfaces that are predominately convex. Further, the hull surfaces utilized in the past have generally been of compound curvature over at least the significant portions of their area. Examples of such a form are U.S. Pat. No. 3,847,103 to Richard T. Takeuchi and U.S. Pat. No. 4,649,851 to Edward P. April.

Proposals have been made for vessels with dual hull elements that are generally cylindrical along the greater part of their lengths. U.S. Pat. No. 3,822,661 issued to Robert Simpson of Lantzville, British Columbia, Canada is one example where it has been proposed to form twin hulls from generally circular tubular elements. The outer surfaces of these hull elements are, however, convex. This hull design does, however, take advantage of the ready availability or easy fabrication of cylindrical tubes from steel sheeting suitable for use in a ship's hull.

the use use of dual cylindrical flotation bodies for a ship's hull is also shown in U.S. Pat. No. 4,552,083 to Terrence W. Schmidt; U.S. Pat. No. 3,447,502 to Reaven Leopold, and U.S. Pat. No. 4,445,453 to Albert E. Morgan. Here, as in the case of Simpson, the hull bodies are convex on their outer surface. They all serve to provide buoyancy for the vessel by the displacement of water, and are intended to be totally submerged to achieve this effect.

Concave hyll elements have been proposed for a small boat hull, as is shown in U.S. Pat. No. 2,099,438 to M. L. Gilbert. This patent shows a design for a light skiff in which stiffness is imparted to a relatively flat and horizontal boat bottom that has the shape of two shallow cylindrical sections that meet along the center-line of the boat. Concave cylindrical boat sides extend downwardly to meet along the outer edges of the two cylindrical panels that form the boat bottom. In this design, however, it cannot be said that two distinct displacement hull elements exist which would serve to provide flotation for the boat that is directed upwardly from the two distinct keels.

All of the foregoing examples of the prior art fail to take full advantage of the potential that is inherent in utilizing dual displacement hulls of cylindrical cross-section, that have a concave exterior surface which is generally free from compound curves over the greater part of its length.

The invention herein takes advantage of these features, and along with further features, provides for a boat or ship's hull that is convenient to construct and which performs advantageously under sea-going conditions.

SUMMARY OF THE INVENTION

The invention comprises a hull for a ship, boat or water-going vessel having two hull portions which extend downwardly to form dual keels and wherein each hull portion:

(a) extends for the greater part of the length of the vessel;

(b) is comprised of paired inner and outer cylindrical elements that are outwardly concave and are free from compound curvature over the greater part of their length, and are joined along their lower longitudinal edges, directly or indirectly, to form a keel.

By a variation on the invention the inner and outer elements of each hull portion may be joined at the keel by a relatively small cylindrical tube to which each of the said elements are joined along the respective sides of the tube. This tube may be compartmentalized to provide more secure flotation.

By a further feature of the invention buoyancy-providing pontoons may be mounted beneath each of the respective keels.

By a further feature of the invention the inner elements of each hull portion are mirror images of each other in cross-section and are joined directly along their upper longitudinal edges. The region of joinder between these inner hull elements may further be provided with a gradually changing rate of curvature around the transition from one element to the other, or may constitute a region of constant curvature.

By a further feature of the invention, as a special cse of the last feature referenced, the inner elements of both hull portions may be comprised of surfaces that define a portion of a continuous right circular cylinder in cross-section.

By a further feature of the invention the hull portions may optionally be closed at least one of their ends by cylindrical end panels that are outwardly concave and are free from compound curvature ovcer substantially the greater portion of their surfaces. Each hull portion may be provided with a closure at at least one end by a pair of outwardly concave end panel portions of the above form that are joined proximate to each other about a common edge that lies in the same plane as and extends upwardly from the keel, the other edges of each respective end panel portion being joined to the respective inner and outer hull elements along the lines of their interesections with the end panels.

By a further feature of the invention, only the inner end panel portions are outwardly concave. Advantageously, the inner end panel portions of both hull portions may be comprised of surfaces that are joined along a longitudinal region of gradually changing or constant curvature. As a further adavantageous configuration, the inner end panels may be comprised of surfaces that define a rigth circular cylinder in cross-section.

By a further feature of the invention the upwardly extending common edge of the end panels on each hull portion is angled upwardly at 30 to 60 degrees, from the direction of the keel to form a bow for the vessel. In a further alternate form the end panels are so angled upwardly at both ends so as to form a double-ended hull.

By a further feature of the invention each hull portion is closed at last one end by an inner end panel portion which is outwardly concave and is angled upwardly in a near vertical direction to form part of the stern-end termination to the hull portions.

By a further feature of the invention, the outer elements of each concave hull portion terminate, before curving through the horizontal plane, along a longitudinal line whereat each hull portion is joined to a sidewall portion of the vessel. Advantageously each sidewall portion may be comprised of a cylindrical surface that it outwardly convex and is free from compound curvature along substantially all of its surface.

By a further feature of the invention, the vessel may be provided with a circular wheel-house which is mounted on its upper deck on a circular pedestal of lesser diameter than the wheel-house.

By adoption of the foregoing features, a vessel may be constructed from steel, aluminum or other suitable panels that may conveniently be formed by bending machinery that need only impart a single direction of curvature to the metal. The use of metal panels so formed can reduce the need for interior ribs, thus reducing construction costs.

The metal need not necessarily by formed into circular tubular sections. "Cylindrical" as used herein refers both to circular cylinders and cylinders, or tubes, of non-circular cross-section. The fact that they are cylindrical, however, means that no compound curves are present.

the hull portions need not be perfectly cylindrical over their entire length. If, for example, at the bow end it were decided to provide each hull portion with an outer end portion which is convex, in making the transition to form the bow, then some metal-forming of surfaces of compound curvature would be required. For the purposes of the invention the advantages of efficiency of construction may be obtained where the hull elements are cylindrical over the greater portion of their lengths or surfaces.

Hulls of the form as described have an advantage in softening the impact of waves on the vessel. The rate of onset of lift from a swell will build-up gradually due to the concave character of the outer surfaces of the dual hull portions. In ice fields this would be particularly adantageous as the impact of the ice on the hull would be more gradual, allowing time for the ice to be displaced. As well, the relatively sharp character of the keel and the bow when similarly formed, will assist in fracturing ice which has formed into solid sheets. If frozen-in this type of hull will more readily resist being crushed.

The dual hull portions provide the basic bouyancy for such a vessel without necessarily requiring immersion of the main body of the vessel. This buoyancy may by supplemented by pontoons that are conveniently sealed circular tubes mounted beneath each keel to support the underside of the boat hull above the water when stationary. At speed, the split hull will tend to scoop-up air and provide a degree of levitation for the boat. As the dual hull portions are outwardly concave a degree of hull levitation will reduce the resistance of the hull to forward motion in the water. This will increase the speed of the vessel and further enhance the air-cushion effect.

A further feature of the invention is that an air dam may be provided by a transverse panel that extends between the hull portions in a region towards the stern, the panel being at least partially depressed from the horizontal plane in its orientation. This panel then serves to trap air that enters between the hulls at the bow and thereby provides for an over-pressure which, in turn, provides for a greater elevation of the hull out of the water.

A further advantage of the concave form of hull of the type described arises from its ready adaptability to receive dual engines, with dual propellers mounted at the stern, in a plane slightly above the keels. By reason of the narrowed dimensions of the hull portions near their keels, the propellers will be presented with a flow of water which is not being significantly laterally displaced as it is approaching the blades. This reduction in turbulence will increase propeller efficiency.

A further advantages of the configuration of boat hull defined by the invention is that water-tight compartments may be readily built-into the individual hull portions, after such hulls have been constructed.

All of the foregoing features of the invention may be more fully understood from the description of the preferred exemplary embodiments which follow. Those embodiments are, however, only intended as being exemplary, the invention being understood to reside in the features and principles that are inherent therein, and as more particularly defined in the claims which follow.

DESCRIPTION OF THE PREFERRED EMBODIMENTS

Figure 1:
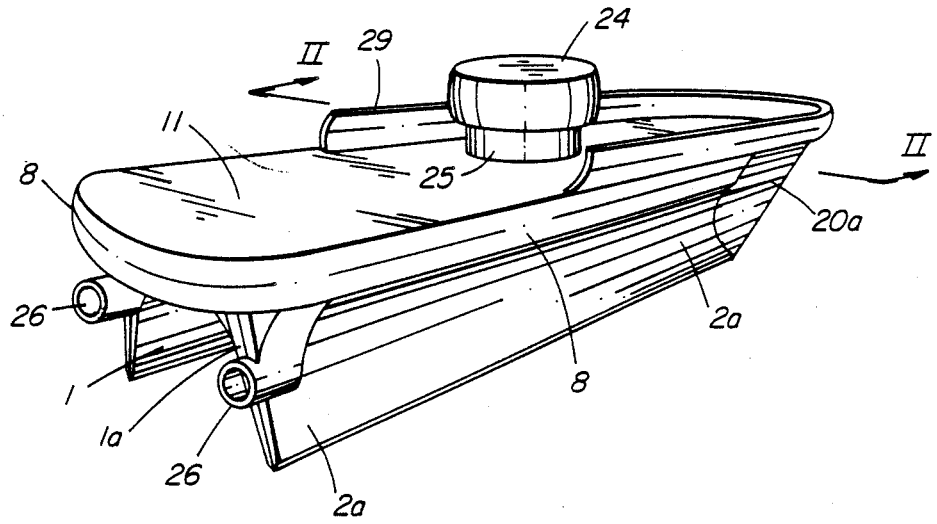
FIG. 1 is a schematic drawing of a perspective view of a vessel incorporating a hull with dual hull portions, according to the design of the invention.

FIG. 1 shows a pictorial view of a boat made in accordance with the invention. In this view can be seen the outer wall 8 of the hold, the upper deck 11 with the wheel house 24 mounted on a pedestal 28 and surrounded by a forward rail 29. Also shown are inner and outer hull side elements 1, **2*a*, the propeller shrouds 26 and an outer bow side panel 20*a***.

Figure 2:
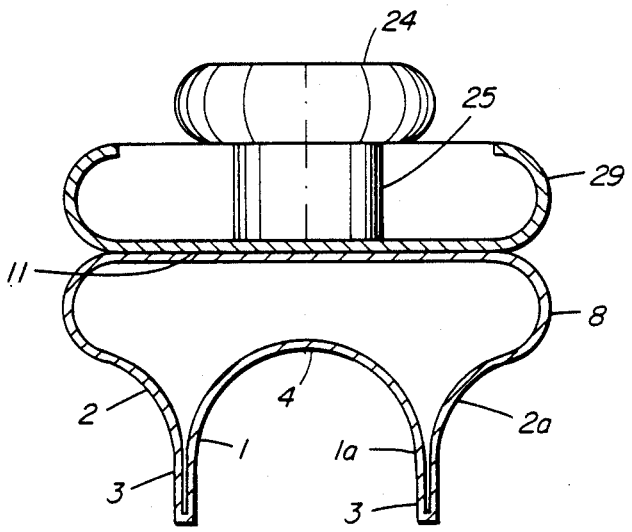
FIG. 2 is a schematic outline of a cross-section of the exterior surfaces of the dual hull portions of FIG. 1, taken just aft of the wheel house and looking towards the bow.

In FIG. 2 the basic character of a hull is shown in a cross-sectional profile. Inner and outer side elements 1, **1*a*, 2, 2*a* of the respective hull portions 3, 3*a* are shown. These side elements, 1, 2** may conveniently be bent from sheet steel, metal or other equivalent material. No ribs need be present to assemble these elements, although optional bracing may be added subsequently.

Figure 3:
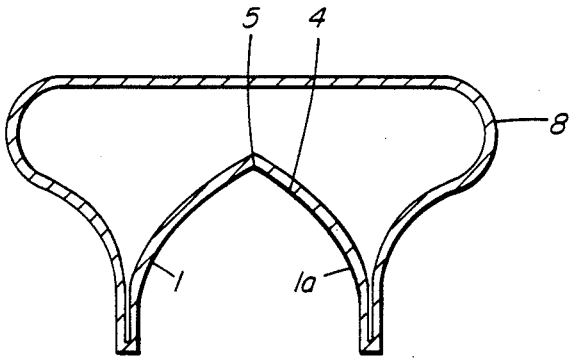
FIG. 3 is a schematic outline of one form of the intersection for the inner surfaces of the hull portions.
Figure 4:
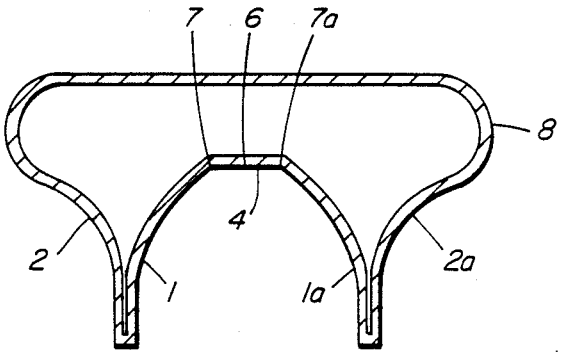
FIG. 4 is a schematic outline of the joinder of the inner surfaces of the hull portions by a flat surface.

In FIGS. 2, 3 and 4 the inner elements, 1, **1*a* are shown as being of mirror symmetry. They are joined along a central region 4 along the longitudinal center line of the hull. When the inner elements 1, 1*a* are of a circular cross-section as in FIG. 5, they may both intersect in the region 4 to form a cross-section that is a portion of a continuous circle. Alternately, they may form an intersecting arch, with a distinct line of intersection 5, as in FIG. 3, or may be joined by a flat panel 6, as in FIG. 4**.

In these latter two cases it is preferable that the inner and outer elements are joined so that the change in the degree of curvature in the vicinity of their joinder is not excessively abrupt. The lines of joinder 7, 7*a* in FIG. 4 provide a change in the degree of curvature, but do not do so abruptly.

The outer hull elements 2, 2*a* need not be symmetrical with the inner elements 1, 1*a*. Such a case is shown in FIG. 4. In this drawing, the outer elements 2, 2*a* have greater curvature than the inner elements 1, 1*a* and are not necessarily circular in cross-section.

Figure 5:
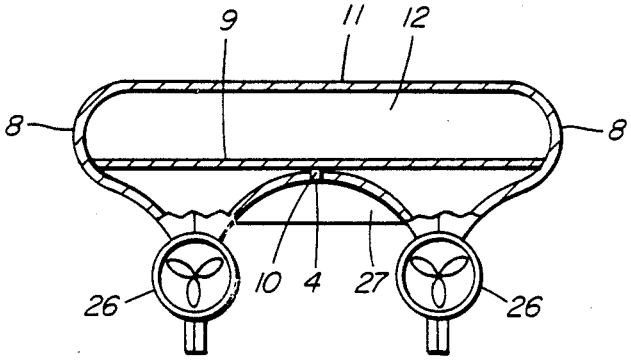
FIG. 5 is a schematic outline of the hull surfaces of FIG. 2 with upper and lower decking features included, as well as outlines for propellers.

FIGS. 3, 4 and 5 also shows side walls 8 for the vessel. Optionally, these may be cylindrical in cross-section to provide strength with a reduced need for ribs. Further, they may be of circular cross-section. In FIG. 5 upper and lower decks 11, 9 are shown within the vessel. These form a hold 12 within which cargo may be carried. The lower deck 9 may be supported at its center by bracing 10 that is mounted in the central region 4 where the inner hull elements 1, 1*a* are joined.

Figure 6:
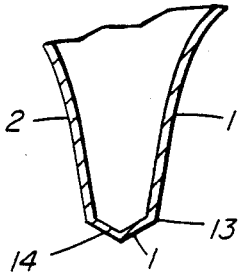
FIG. 6 is a detail of a means of joinder of the inner and outer hull elements.
Figure 7:
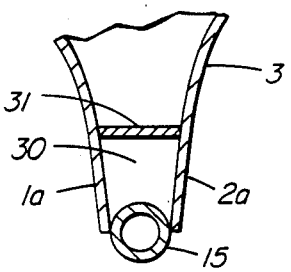
FIG. 7 is a further detail of a means of joinder of the inner and outer hull elements.

Details of the joinder of the hull elements 1, 1*a* and 2, 2*a* of a single hull portion are shown in FIGS. 6 and 7.

In FIG. 6 the hull elements 1, 2 meet at a keel region 13 where they are joined by an angle iron 14. The use of angle iron is convenient because it is a stock item. The hull elements could be joined directly. However, the width of the angle iron 14 provides a separation of the inner and outer hull elements 1, 2 that increases the flotation provided by the hull portion. The optimal width may be selected in accordance with engineering considerations respecting the strength and availability of the joining element and the degree and schedule of flotation desired.

In FIG. 7 a cylindrical tube 15 is used as the joining element. Circular steel pipe is conveniently available as a stock item for this application. Again, the width of the tube 15 may be chosen by the same criteria as for the angle iron. The use of tubing in this application allows a further advantage. By compartmentalizing the tube 1 permanent sealed flotation chambers may be provided which, if of sufficient size, will provide protection against sinking, in the event that the hull is ruptured. By reason of the relative width of the vessel formed using the invention, it is practical to install such flotation near the keel region.

Also shown in FIG. 7 is an example of a water-tight chamber 30 formed within the hull portion 3 by a transverse plate 31. Such chambers provide security in the event that a portion of the hull is breached.

Figure 8:
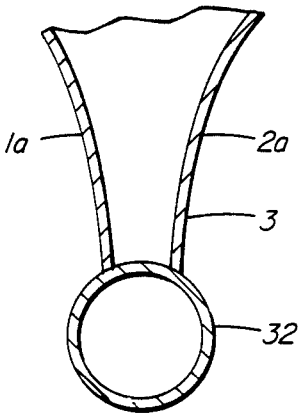
FIG. 8 is a detail of the keel of the hull element with a pontoon attached.

FIG. 8 shows a further alternate arrangement whereby longitudinal sealed cylinders 32 may be attached beneath the hull portions 3 to serve as pontoons and provide even further flotation. It is desirable that the hull be provided with sufficient floatation to elevate the central region 4 above the water in calm conditions. This is to provide for space for sea-swells to rise under the boat without lifting the boat as fully as the rise of the swell. A major advantage of a hull according to the invention, besides its ease of construction, is the manner in which it will cushion a vessel from heavy seas.

Figure 9:
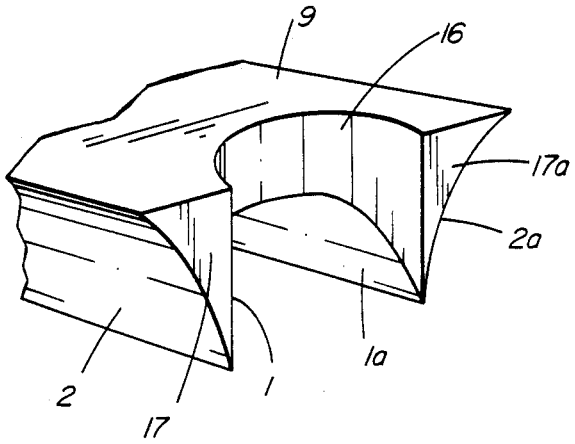
FIG. 9 is a perspective schematic view of the stern of a vessel, closed in accordance with a feature of the invention.
Figure 10:
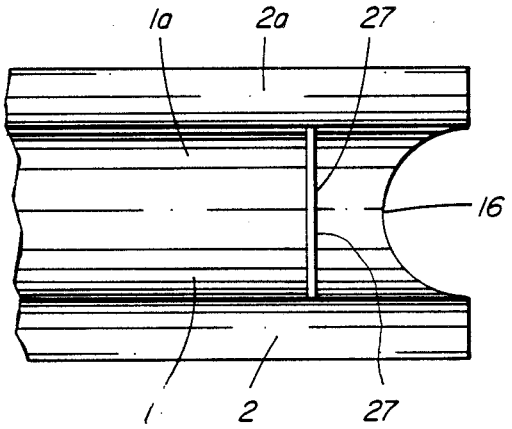
FIG. 10 is an underside plan view of the hull of FIG. 9.

The paired hull portions may be closed at the stern by either flat panels or by a generally vertical cylindrical end panel that is outwardly concave. This is shown in FIGS. 9, 10 where a cylindrical single tube element 16 intersects with both inner hull elements 1, 1*a* sealing-off that part of these hull portions. The outer halves of the hull portions 2, 2*a* may be sealed-off at the stern by flat plates 17, 17*a*, or by outwardly concave plates (not shown).

FIG. 10 also shows the edge of a vertical plate 27 which extends between the hull elements 1, 1*a* to serve as an air dam. The air dam traps air, building-up pressure under the boat when it is in motion, thus providing a cushioning suppor when the baot passes over waves.

Figure 11:
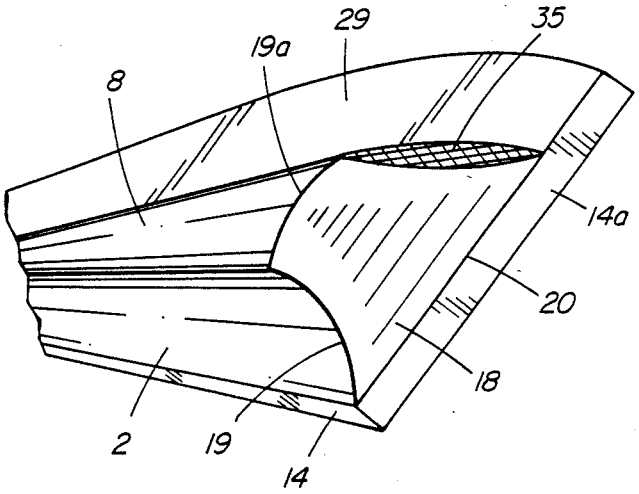
FIG. 11 is a perspective schematic view of the bow of a vessel according to the invention.
Figure 12:
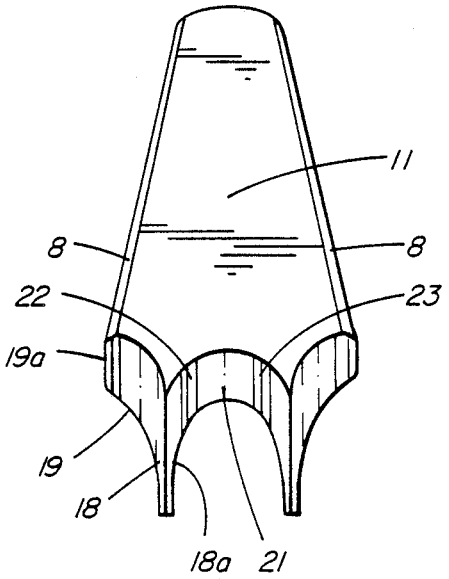
FIG. 12 is a longitudinal perspective view of a vessel hull having a bow as in FIG. 11.

At the bow the respective hull elements may be closed using paired inclined cylindrical end panels having inner and outer portions 18 and 18*a* as shown in FIGS. 11 and 12. The end panel portion 18 joins along its respective outer side edges 19, 19*a*with the outer hull element 2, and vessel sidewalls 8, thus presenting an angled concave surface towards the sea as the boat advances over the water. The end panel portion 18, terminates at a forward edge 20 which is attached to stiffener element 14*a*. Both are angled at the same angle as the inclination of the end panel 18, and are therefore straight.

The inner ends of the hull portions 1, 1*a* may then be closed with a unitary inner end panel 21. This may preferably be a concave cylindrical surface, that extends from one hull portion to the other. Such a configuration is shown in FIG. 12 where, for clarity, the rail 29 has been omitted.

The angle of the bow edges 14*a* and 20 may be selected to provide the best entry into the sea, while accommodating engineering considerations such as the amount of metal required and effects on interior space. An angle of between 30–60 degrees upwardly to the direction of the keel is considered satisfactory.

FIGS. 9 and 10 depict end panels of circular cross-section. This is merely optional. The end closures for the hull portions may be in the form of non-circular cylindrical elements, or may even be of more complex forms. The use of curved surfaces of non-compound curvature is, however, preferred.

As can be seen in FIG. 11, a portion 35 of the upper deck 11 is exposed to the sea on its underneath side. This deck portion 35 may optionally be perforated to provide relief from the force of the sea, rising from underneath. Further, the respective side portions 22, 23 of the inner end panels 21 need not be joined along a region of continuous curvature, but may bridge in a manner analogous to FIGS. 3 and 4.

FIG. 1 shows a circular wheelhouse 24 that is mounted on a circular cylindrical pedestal 25 of smaller diameter. This form of wheelhouse 24 is believed to be more resistant to heavy seas that may wash over the sides of the vessel.

FIG. 1 also shows propeller housings 26 that are also depicted in FIG. 5. As will be seen from this latter figure, the water flow from the bow to the propeller housings 26 are less unobstructed than would occur with a broader hull. This should improve the efficiency of the propellers due to the reduced presence of turbulence in the water that enters the housings 26.

The foregoing is a description of a variety of preferred embodiments of the invention, which are exemplary only. These and further features of the invention are further described and defined in the claims which follow.

I claim:

1. A hull for a water-going vessel having two hull portions, which hull portions extend downwardly to form dual keels and wherein each hull portion:

(a) extends for the greater part of the length of the vessel;

(b) is comprised of paired inner and outer cylindrical elements that are outwardly concave and are free from compound curvature over the greater part of their length, and are joined along their longitudinal edges, directly or indirectly, to form a keel, and (c) wherein said hull portions are respectively closed at at least one of their ends by a pair of cylindrical end panels that are outwardly concave and are free from compound curvature over substantially the greater portion of their surfaces.

2. A hull as in claim 1 wherein said end panels are joined proximate to each other about a common edge that lies in the same plane as and extends upwardly from, the keel.

3. A hull as in claim 1 wherein said end panels are comprised on each hull portion of an inner end panel portion, the inner end panel portions of both hull portions being joined along a longitudinal region of gradually changing or constant curvature.

4. A hull as in claim 3 wherein said inner end panel portions are comprised of surfaces that define a right circular cylinder in cross-section.

5. A hull in claim 1 wherein the upwardly extending common edge to the said end panels on each hull portion is angled upwardly at between 30 to 60 degrees from the direction of the keel to form a bow for the vessel.

6. A hull as in claim 5 wherein said upwardly angled end panels are provided at both ends of said hull.

7. A hull for a water-going vessel having two hull portions, which hull portions extend downwardly to form dual keels and wherein each hull portion:

(a) extends for the greater part of the length of the vessel;

(b) is comprised of paired inner and outer cylindrical elements that are outwardly concave and are free from compound curvature over the greater part of their length, and are joined along their lower longitudinal edges, directly or indirectly, to form a keel, and (c) wherein said hull portons are respectively closed at the bow ends by a pair of cylindrical end panels that are outwardly concave and are free from compound curvature over substantially the greater portion the their surfaces and (d) wherein said hull portions are respectively partially closed at the stern ends by inner end panel portions which are outwardly concave, said inner end panel portions on each hull portion being angled upwardly in a near vertical direction to form part of the stern end termination to the hull portions.

* * * * *